US012092369B2

(12) United States Patent
Lyons et al.

(10) Patent No.: US 12,092,369 B2
(45) Date of Patent: Sep. 17, 2024

(54) COMBUSTION AIR BLOWER WITH EMBOSSED HOUSING

(71) Applicant: Regal Beloit America, Inc., Beloit, WI (US)

(72) Inventors: Leslie Alan Lyons, Cassville, MO (US); David Allen Fisher, Cassville, MO (US); Jeffrey Jay Long, Purdy, MO (US)

(73) Assignee: Regal Beloit America, Inc., Beloit, WI (US)

( * ) Notice: Subject to any disclaimer, the term of this patent is extended or adjusted under 35 U.S.C. 154(b) by 462 days.

(21) Appl. No.: 17/553,421

(22) Filed: Dec. 16, 2021

(65) Prior Publication Data

US 2022/0107116 A1 Apr. 7, 2022

Related U.S. Application Data

(62) Division of application No. 15/495,262, filed on Apr. 24, 2017, now Pat. No. 11,215,380.

(51) Int. Cl.
*F24H 9/00* (2022.01)
*F23D 14/70* (2006.01)

(52) U.S. Cl.
CPC ..... *F24H 9/0068* (2013.01); *F23D 14/70* (2013.01); *F24H 9/0073* (2013.01)

(58) Field of Classification Search
CPC ..... F23D 14/70; F24H 9/0068; F24H 9/0073
See application file for complete search history.

(56) References Cited

U.S. PATENT DOCUMENTS 2,095,230 A * 10/1937 Camerino ..... F04D 29/4226 431/2
2,290,423 A * 7/1942 Funk ..... F04D 29/4213 415/206
2,711,285 A 6/1955 Burrowes
3,191,851 A * 6/1965 Wood ..... F04D 29/664 415/119
3,918,885 A * 11/1975 Palm ..... F23D 11/001 431/185
4,239,482 A * 12/1980 Durfee ..... F23D 11/001 431/350
4,373,901 A 2/1983 Kaplan et al.
RE37,009 E 1/2001 Diesch
(Continued)

*Primary Examiner* — Michael G Hoang
*Assistant Examiner* — Logan P Jones
(74) *Attorney, Agent, or Firm* — Thompson Coburn LLP

(57) ABSTRACT

A combustion air blower includes a blower housing, an impeller fan within the blower housing, and an embossment to restrict airflow from the combustion air blower. The blower housing has a discharge conduit defining a discharge passageway. The discharge conduit is adapted and configured to receive a baffle such that, when the baffle is received, the baffle extends inwardly into the discharge passageway from a first wall towards a second wall opposite the first wall. The baffle restricts airflow within the discharge passageway. The embossment is in the discharge passageway and in the second wall and extends towards the first wall such that the embossment restricts airflow within the discharge passageway. The embossment cooperates with a baffle to provide a reduced cross sectional area of the discharge passageway in comparison to an upstream portion.

17 Claims, 3 Drawing Sheets

(56) References Cited

U.S. PATENT DOCUMENTS

| | | | | |
|---|---|---|---|---|
| 6,929,448 | B1 * | 8/2005 | Lyons | F04D 27/003 415/206 |
| 6,979,169 | B2 * | 12/2005 | Penlesky | F04D 29/626 415/214.1 |
| 2015/0211751 | A1 | 7/2015 | Wortman et al. | |
| 2018/0078890 | A1 | 3/2018 | Roston et al. | |
| 2018/0187908 | A1 | 7/2018 | Brendel | |

* cited by examiner

COMBUSTION AIR BLOWER WITH EMBOSSED HOUSING

CROSS-REFERENCE TO RELATED APPLICATIONS

This application is a divisional of U.S. patent application Ser. No. 15/495,262, filed Apr. 24, 2017, entitled COMBUSTION AIR BLOWER WITH EMBOSSED HOUSING, the entire disclosure of which is incorporated herein by reference.

STATEMENT REGARDING FEDERALLY SPONSORED RESEARCH OR DEVELOPMENT

Not Applicable.

APPENDIX

Not Applicable.

BACKGROUND

Field of the Disclosure

The present disclosure pertains generally to a combustion air blower for use with a furnace or water heater, and more particularly, to a combustion air blower having a housing adapted and configured to cooperate with interchangeable baffles to provide a specific airflow.

General Background

Typical combustion air blowers include an impeller fan driven by a permanent split capacitor motor. Some combustion air blowers are compatible with furnaces of differing capacity through the use of interchangeable baffles designed to provide a specific airflow such that thermal efficiency may be increased. A disadvantage with these systems is that the permanent split capacitor motor is more expensive than other types of motors and these systems fail to provide sufficient thermal efficiency.

The present disclosure is directed to overcoming one or more of the problems set forth above.

SUMMARY

One aspect of the present disclosure is a combustion air blower including a blower housing, an impeller fan within the blower housing, and an embossment adapted and configured to restrict airflow from the combustion air blower. The blower housing has an inlet and the discharge conduit. The discharge conduit extends away from the impeller fan and has first, second, third and fourth walls. The first, second, third, and fourth walls of the discharge conduit define a discharge passageway with the second wall being opposite the first wall. The third wall extends between the first and second walls, and the fourth wall extends between the first and second walls. The first wall includes a first portion and a second portion. The second portion of the first wall is upstream of the first portion of the first wall. The discharge conduit is adapted and configured to receive a baffle in the discharge passageway adjacent the first portion of the first wall of the discharge conduit. The discharge conduit is adapted and configured such that, when the baffle is received in the discharge passageway adjacent the first portion of the first wall, the baffle extends inwardly into the discharge passageway from the first wall towards the second wall and restricts airflow within the discharge passageway. The embossment is in one or more of the second wall, the third wall, and the fourth wall, and the embossment extends inwardly into the discharge passageway such that the embossment restricts airflow within the discharge passageway. The discharge passageway has a first cross-sectional area in a first plane perpendicular to and through the first portion of the first wall, and the discharge passageway has a second cross-sectional area in a second plane perpendicular to and through the second portion of the first wall. The embossment is downstream of the second plane, and the first plane passes through the embossment such that the first cross-sectional area is less than the second cross-sectional area. The discharge conduit is adapted and configured such that when the baffle is within the discharge passageway and adjacent the first portion of the first wall, the discharge passageway has an effective cross-sectional area in the first plane. The effective cross-sectional area is the first cross-sectional area less the cross sectional area of the baffle in the first plane.

Another aspect of the present disclosure is a method of installing a replacement combustion air blower comprising. The method includes coupling the replacement combustion air blower to a furnace system such that a discharge conduit of the replacement combustion air blower is positioned to supply air to a combustion device of the furnace. The replacement combustion air blower includes a blower housing, an impeller fan within the blower housing, and an embossment adapted and configured to restrict airflow from the combustion air blower. The blower housing has an inlet and the discharge conduit. The discharge conduit extends away from the impeller fan and has first, second, third and fourth walls. The first, second, third, and fourth walls of the discharge conduit define a discharge passageway with the second wall being opposite the first wall. The third wall extends between the first and second walls, and the fourth wall extends between the first and second walls. The first wall includes a first portion and a second portion, where the second portion of the first wall is upstream of the first portion of the first wall. The discharge conduit is adapted and configured to receive a baffle in the discharge passageway adjacent the first portion of the first wall of the discharge conduit. The discharge conduit is adapted and configured such that, when the baffle is received in the discharge passageway adjacent the first portion of the first wall, the baffle extends inwardly into the discharge passageway from the first wall towards the second wall and restricts airflow within the discharge passageway. The embossment is in one or more of the second wall, the third wall, and the fourth wall, and the embossment extends inwardly into the discharge passageway such that the embossment restricts airflow within the discharge passageway. The discharge passageway has a first cross-sectional area in a first plane perpendicular to and through the first portion of the first wall, and the discharge passageway has a second cross-sectional area in a second plane perpendicular to and through the second portion of the first wall. The embossment is downstream of the second plane, and the first plane passes through the embossment such that the first cross-sectional area is less than the second cross-sectional area. The discharge conduit is adapted and configured such that when the baffle is within the discharge passageway and adjacent the first portion of the first wall, the discharge passageway has an effective cross-sectional area in the first plane. The effective cross-sectional area is the first cross-sectional area less the cross sectional area of the baffle in the first plane when the baffle is within the discharge passageway adjacent the first portion of the first wall.

The method further includes selecting the baffle from among a first baffle and a second baffle. The first baffle has a greater cross-sectional area than the second baffle.

Further features and advantages of the present disclosure, as well as the structure and operation of various embodiments of the present disclosure, are described in detail below with reference to the accompanying drawings.

BRIEF DESCRIPTION OF THE DRAWINGS

The accompanying drawings, which are incorporated in and form a part of the specification, illustrate the embodiments of the present disclosure and together with the description, serve to explain the principles of the disclosed embodiments. In the drawings.

Figure 1:
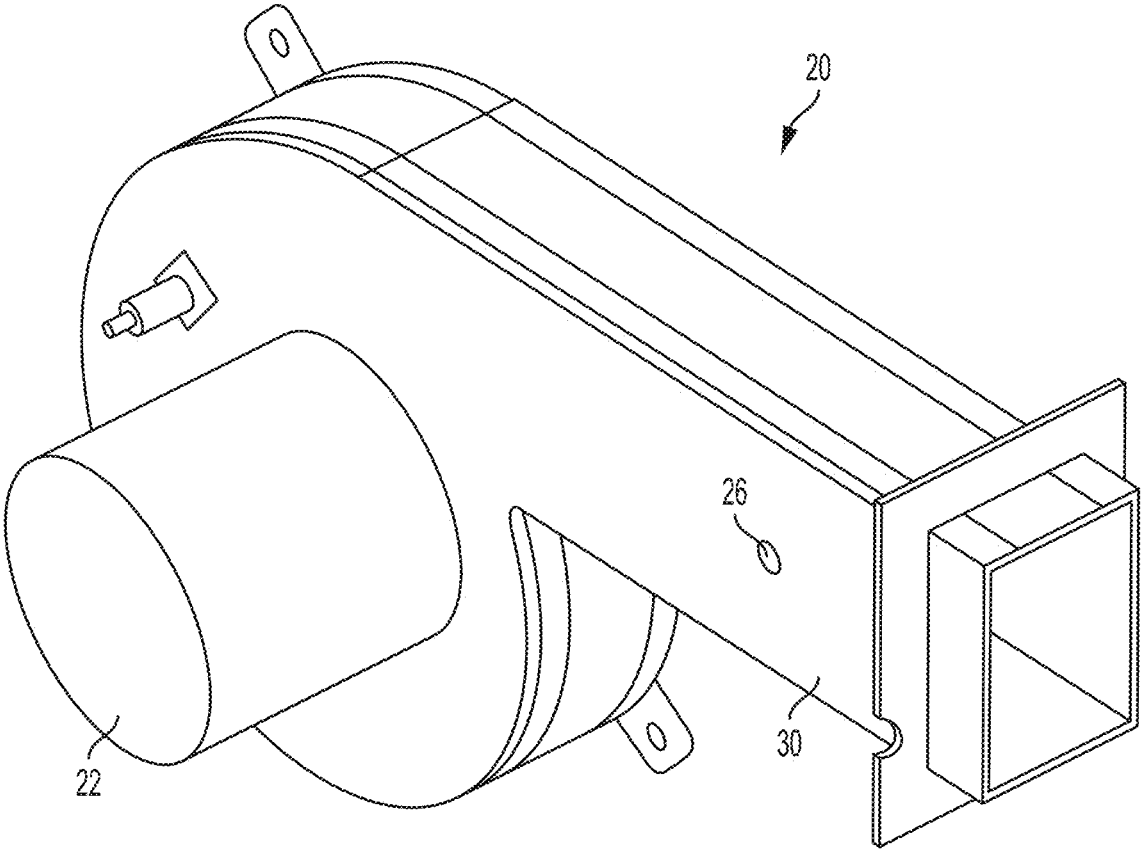
FIG. 1 is a perspective view of a combustion air blower having a shaded pole motor and an embossed blower housing capable of receiving a baffle.

Reference numerals in the written specification and in the drawing figures indicate corresponding items.

DETAILED DESCRIPTION

Figure 2:
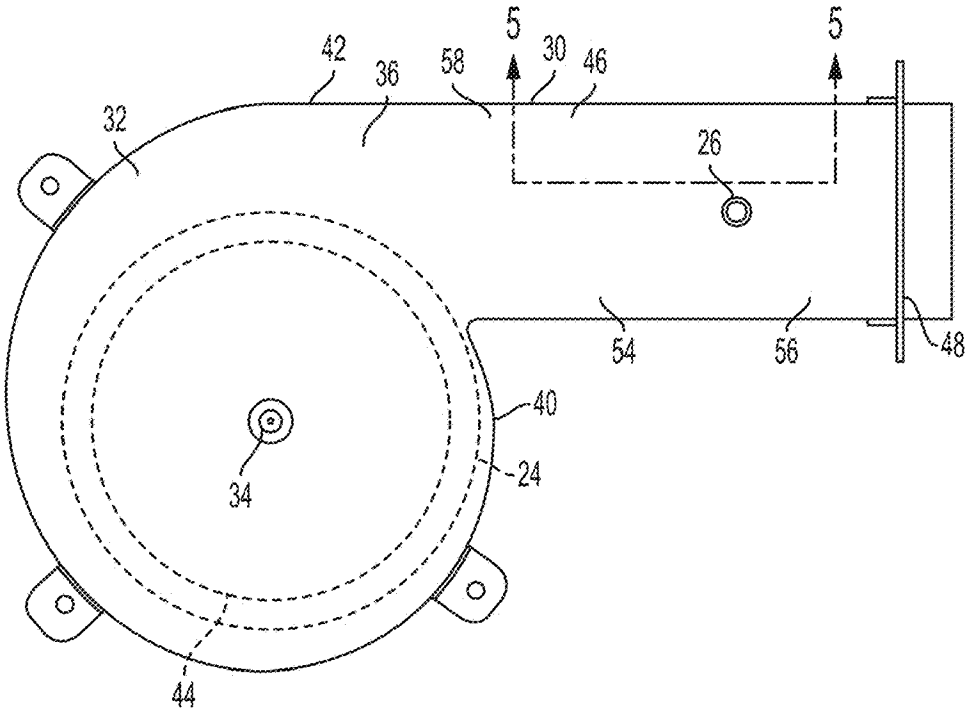
FIG. 2 is a side view of the blower housing shown in FIG. 1.

FIG. 1 depicts an embodiment of a combustion air blower 20 that overcomes the cost and thermal efficiency problems of existing combustion air blowers. The combustion air blower 20 includes a shaded pole motor 22, an impeller fan 24 (shown in FIG. 2) driven by the shaded pole motor 22, and a blower housing 30. Optionally, the combustion air blower 20 includes a choke hole 26. Advantageously, the shaded pole motor 22 is simpler and less expensive than a permanent split capacitor motor, the type typically used with combustion air blowers. The shaded pole motor 22 may also be longer lasting, more efficient, and/or simpler and less expensive to repair as a result of the simpler construction in comparison to a permanent split capacitor motor.

Figure 3:
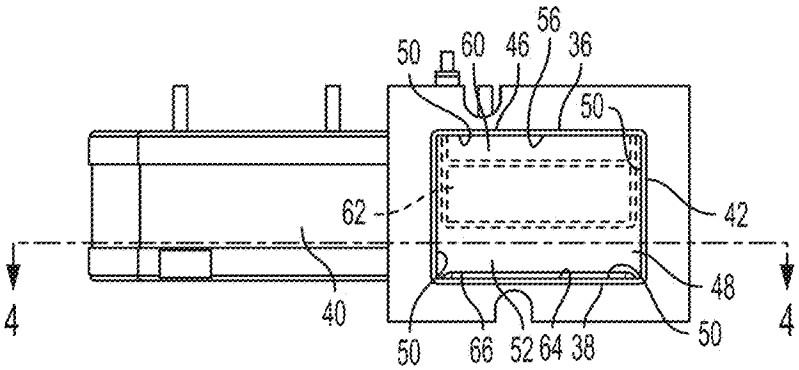
FIG. 3 is an end view of the blower housing shown in FIG. 1.
Figure 5:
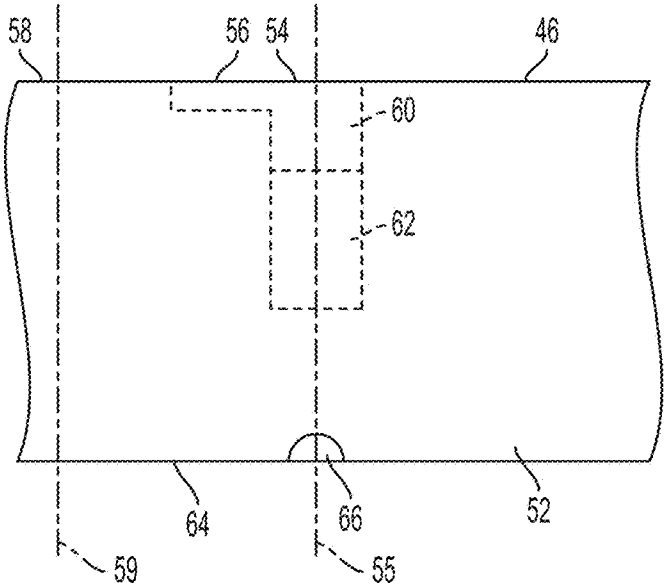
FIG. 5 is a cross-sectional view taken along the plane 5-5 of FIG. 2.
Figure 4:
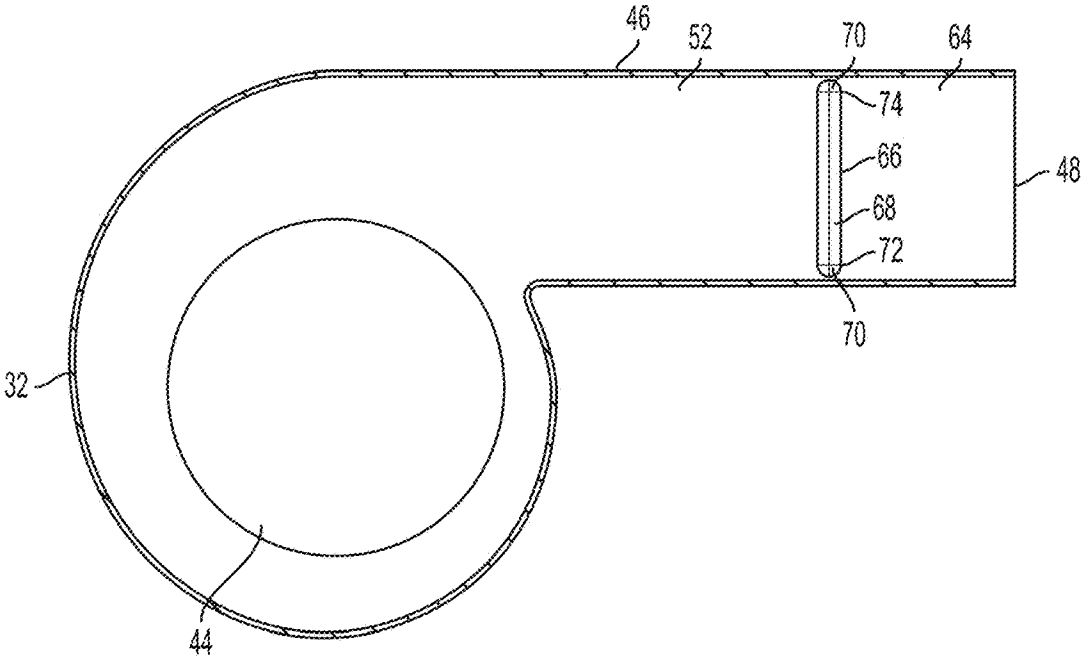
FIG. 4 is a cross-sectional view taken along the plane 4-4 of FIG. 3.

The shaded pole motor 22 is adapted and configured such that the combustion air blower 20 provides sufficient airflow for a variety of systems such as furnaces, burners, water heaters, etc. with different capacities. Sufficient airflow may be a desired airflow corresponding to a desired thermal efficiency or may be an airflow sufficient for combustion. In order to provide a desired thermal efficiency across systems with varying capacity, the airflow of the combustion air blower 20 is controlled through the use of baffles with varying dimensions to restrict airflow from the combustion air blower 20. Advantageously, the blower housing 30 includes an embossment (shown in FIGS. 3-5) to further control the restriction of airflow from combustion air blower 20. As a result, the combustion air blower 20 provides for greater thermal efficiency in comparison to combustion air blowers not having the features described herein.

For example, and without limitation, the combustion air blower 20 is suitable for use with both a furnace having a capacity of 50,000 British thermal units (BTU) and a furnace having a capacity of 125,000 BTU. The shaded pole motor 22 is sized accordingly to provide sufficient airflow for the larger capacity furnace. To provide for a desired thermal efficiency for either of the two furnaces, the combustion air blower 20 is adapted and configured to receive baffles (shown in FIG. 3) with different dimensions corresponding to each of the furnaces. The baffles restrict airflow within the blower housing 30 to improve the thermal efficiency of the furnace system. The blower housing 30 also includes an embossment (shown in FIGS. 3-5) that cooperates with one of the baffles and further restricts airflow. As described herein in greater detail with reference to FIGS. 2-5, the baffles and embossment provide for increased thermal efficiency of the furnace system in which the combustion air blower 20 is installed by controlling the airflow from the impeller fan (shown in FIG. 2) driven by the shaded pole motor 22.

In some embodiments, the combustion air blower 20 further includes a choke hole 26 adapted and configured to control airflow through the combustion air blower 20. Advantageously, the embossment (shown in FIGS. 3-5) in the blower housing 30 allows for further airflow control without the need to change the choke hole 26 in relation to an existing combustion air blower than is being replaced by the combustion air flower 20 described herein.

Referring now to FIGS. 2-5, the combustion air blower 20 includes the blower housing 30 and the impeller fan 24. The impeller fan 24 is driven by the shaded pole motor 22 about an axis 34. The impeller fan 24 is positioned within the blower housing 30. For example, and without limitation, the impeller fan 24 is positioned within a volute portion 32 of the blower housing 30. The blower housing 30 has at least a top side portion 36, bottom side portion 38, left side portion 40, and right side portion 42. The axis 34 about which the impeller fan 24 rotates is substantially perpendicular to the top side portion 36 and the bottom side portion 38.

The blower housing 30 further includes an inlet 44 and a discharge conduit 46. The inlet 44 is substantially concentric with the impeller fan 24. The inlet 44 is positioned in and defined by the bottom side portion 38 of the blower housing 30 and provides an opening through which the impeller fan 24 draws air. The inlet 44 is positioned within the volute portion volute portion 32 of the blower housing 30. The discharge conduit 46 extends away from the impeller fan 24. For example, and without limitation, the discharge conduit 46 extends tangentially from the volute portion 32. The discharge conduit terminates in a discharge opening 48. In some embodiments, the discharge opening 48 is rectangular. In alternative embodiments, the discharge opening is circular or has other dimensions. The discharge conduit 46 may be coupled to a duct such that air blown by the combustion air blower 20 enters through the inlet 44 and exits thought the discharge opening 48 into the duct.

The discharge conduit 46 has four walls 50. In some embodiments, the entirety of the discharge conduit has four walls 50 and a rectangular cross section. In alternative embodiments, the discharge conduit 46 has four walls 50 for a partial length of the discharge conduit 46. For example, and without limitation, the discharge conduit 46 may have a circular cross section for one or more portions running a partial length of the discharge conduit 46 with at least one portion of the discharge conduit 46 running a partial length of the discharge conduit 46 having four walls 50.

The discharge conduit 46 defines a discharge passageway 52. For example, and without limitation, the four walls 50 define a discharge passageway 52 running for all or a portion of the length of the discharge conduit 46. The discharge passageway 52 has a first wall 56 with a first portion 54 and a second portion 58. For example, the first portion 54 of the first wall 56 extends for a length of the discharge passageway 52. The second portion 58 of the first wall 56 extends for a different length of the discharge passageway 52. For example, and without limitation, the first portion 54 of the first wall 56 extends for a length that includes a position where a baffle may be installed. The second portion 58 of the first wall 56 extends for a length of the first wall 56 at a location upstream of the first portion 54. In some embodiments, the first portion 54 of the first wall 54 is upstream of the choke hole 26 and the second portion 58 of the first wall 54 is further upstream and spaced apart from the first portion 54. In alternative embodiments, the first portion 54 of the first wall 56 and/or the second portion 58 of the first wall 56 are in other relationships with the discharge conduit 46. For example, and without limitation, the first portion 54 of the first wall 56 is located downstream of the choke hole 26. In further embodiments, the blower housing 30 does not include a choke hole 26.

The second portion 58 of the first wall 56 is upstream of the first portion 54 of the first wall 56. The discharge conduit 46 is adapted and configured to receive a baffle 60, 62 in the first portion 54 of the discharge passageway 52 adjacent the first wall 56 of the discharge conduit 46. For example, and without limitation, the discharge conduit 46 receives a baffle 60, 62 when the baffle 60, 62 is inserted into the discharge passageway 52 and secured to the first wall 56 of the discharge conduit 46. The baffle 60, 62 may be secured to the first wall 56 using a fastener such as a rivet, screw, adhesive or the like. The baffle 60, 62 may be secured to the first wall 56 using a welding technique or other suitable technique.

When the baffle 60, 62 is within (e.g., installed in or received in) in the first portion 54 of the first wall 56 forming the discharge passageway 52, the baffle 60, 62 extends inwardly into the discharge passageway 52 from the first wall 56 towards a second wall 64. The second wall 64 is opposite the first wall 56. The discharge conduit 46 further includes a third wall and a fourth wall. The third wall extends between the first wall 56 and the second wall 64. The fourth wall extends between the first wall 56 and the second wall 64. The baffle 60, 62 is positioned between the first wall 56, second wall 64, third wall, and the fourth wall. The baffle 60, 62 restricts airflow within the discharge passageway 52.

The discharge passageway 52 has a first cross sectional area in a first plane 55 perpendicular to and through the first portion 54 of the first wall 56. The discharge passageway 52 also has a second cross sectional area in a second plane 59 perpendicular to and through the second portion 58 of the first wall 56. The baffle 60, 62, when positioned in the discharge passageway 52, restricts airflow in the discharge passageway 52 resulting in an effective cross-sectional area of the discharge passageway 52 in the first plane 55 that is less than the first cross-sectional area in the first plane 55.

For example, and without limitation, a first baffle 60 is sized to have a cross-sectional area of at least about twenty percent of the second cross-sectional area and no more than about thirty percent of the second cross-sectional area, e.g., the unobstructed cross sectional area of the discharge passageway 52. For example, and without limitation, the first baffle 60 may be sized to have a cross-sectional area of substantially twenty five percent of the second cross-sectional area.

A second baffle 62 is sized to have a cross-sectional area of at least about fifty five percent of the second cross-sectional area and no more than about sixty five percent of the second cross-sectional area. For example, and without limitation, the second baffle 62 may be sized to have a cross-sectional area of substantially sixty percent of the second cross-sectional area. In some embodiments, the discharge passageway may receive baffles with other sizes and/or configurations.

The combustion air blower 20 includes an embossment 66. The embossment 66 restricts airflow from combustion air blower 20 and can cooperate with one of the baffles 60, 62 to further restrict airflow. The embossment 66 provides for increased thermal efficiency of the furnace system in which the combustion air blower 20 is installed by controlling, with the baffles 60, 62, the airflow from the impeller fan 24.

The embossment 66 is opposite the first portion 54 of the first wall 56 of the discharge passageway 52. The embossment 66 is within the first plane 55 perpendicular to and through the first portion 54 of the first wall 56. The embossment 66 is in the second wall 64 and extends towards the first wall 56. For example, and without limitation, the embossment 66 is formed in the second wall 64. The embossment 66 may be stamped into the second wall 64 when the blower housing 30 is constructed of a malleable material such as, for example, a metal. Alternatively, the embossment 66 may be formed in the second wall 64 during casting or molding of the blower housing 30 when the blower housing 30 is made of a material such as, for example, a plastic or metal. In still further alternative embodiments, the embossment 66 may be a separate component added to the second wall 64.

The embossment 66 restricts airflow within the discharge passageway 52. As a result of the embossment 66, the first cross sectional area of the discharge passageway 52 in the first plane 55 perpendicular to and through the first portion 54 of the first wall 56 is less than the second cross-sectional area in the second plane 59 perpendicular to and through the second portion 58 of the first wall 56 upstream of the first portion 54. The first plane 55 passes through the embossment 66.

The embossment 66 restricts airflow irrespective of whether a baffle 60, 62 is positioned within the discharge passageway 52. In some embodiments, the embossment 66 is sized such that the first cross-sectional area is about ninety three percent of the second cross-sectional area. For example, the embossment 66 is sized such that the first cross-sectional area is at least about ninety two percent of the second cross-sectional area and no more than about ninety four percent of the second cross-sectional area. In an alternative embodiment, the embossment 66 is sized such that the first cross-sectional area is at least about eighty eight percent of the second cross-sectional area and no more than about ninety five percent of the second cross-sectional area. In a further alternative embodiments, the embossment 66 is sized such that the first cross-sectional area is at least about ninety three percent of the second cross-sectional area and no more than about ninety four percent of the second cross-sectional area. In still further alternative embodiments, the embossment 66 is sized such that the first cross-sectional area is any area suitable for the functioning of the combustion air blower 20 described herein.

The embossment 66 is adapted and configured to cooperate with any baffle 60, 62 received in the discharge passageway 52 such that the effective cross-sectional area of the discharge passageway 52 in the first plane 55 is less than the second cross-sectional area upstream and is also less than the first cross-sectional area, the cross-sectional area at the same location but without any baffle 60, 62. Thus, the embossment 66 cooperates with any baffle 60, 62 received in the discharge passageway 52 to provide for a specific airflow restriction. For example, the embossment 66 is positioned in the second wall 64 such that the embossment 66 is opposite the first portion 58 of the first wall 56. Therefore, the embossment 66 is positioned substantially below or opposite a baffle 60, 62 when the baffle 60, 62 is inserted or installed in the discharge passageway 52. For example, and without limitation, the embossment 66 is positioned substantially within the same plane with any baffle 60, 62 in the discharge passageway 52; the plane being substantially perpendicular to a direction of airflow within the discharge passageway 52.

In some embodiments, the embossment 66 includes a semi-cylindrical portion 68 and two quarter sphere portions 70. The semi-cylindrical portion extends from a first end 72 to a second end 74 transversely to the discharge passageway 52. One quarter sphere portion 70 extends outward from the first end 72 and another quarter sphere portion 70 extends outward from the second end 74. In alternative embodiments, the embossment 66 has alternative shapes or configurations.

The embossment 66 cooperates with a baffle 60, 62 to restrict airflow such that the combustion air blower 20 provides airflow for a specific heating system. For example, and without limitation, the combustion air blower 20 is adapted and configured to cooperate with one of a first baffle 60 or a second baffle 62 such that the combustion air blower 20 is operable with either a 50,000 BTU furnace or 125,000 BTU furnace. The shaded pole motor 22 is sized to provide sufficient airflow for combustion with the 125,000 BTU furnace. If the shaded pole motor 22 is sized for the 50,000 BTU furnace, the combustion air blower 22, when used with the 125,000 BTU furnace, will result in poor combustion. Therefore, the shaded pole motor 22 is sized for use with the 125,000 BTU furnace. As a result, the combustion air blower 22 provides a greater airflow than needed for the 50,000 BTU furnace resulting in poor thermal efficiency of the 50,000 BTU furnace.

To control the airflow depending on application, use with either the 50,000 BTU or 125,000 BTU furnace, baffles 60, 62 are used. By restricting the airflow using one of the baffles 60, 62 the thermal efficiency of the furnace is increased. When replacing an existing combustion air blower, for example one using a permanent split capacitor motor, there may be existing an existing baffle. However, to reuse the existing baffle with the combustion air blower 20 having a shaded pole motor 22, the airflow needs to be further restricted to maintain or increase the thermal efficiency of the furnace. Therefore, the combustion air blower 20 includes the embossment 66 that cooperates with the baffle. Advantageously, the embossment 66 maintains or increases the thermal efficiency of the furnace now having the combustion air blower 20 without requiring new or additional baffles 60, 62.

For the 125,000 BTU furnace, the combustion air blower 20 is used with the first baffle 60. The first baffle 60 is smaller than the second baffle 62. The embossment 66 cooperates with the first baffle 60 such that the effective cross-sectional area of the discharge passageway 52 is at least about sixty six percent of the second cross-sectional area of the discharge passageway 52 and no more than about sixty nine percent of the second cross-sectional area. In alternative embodiments, the embossment 66 cooperates with the first baffle 60 such that the effective cross-sectional area is at least about sixty seven percent of the second cross-sectional area and no more than about sixty eight percent of the second cross-sectional area. In further alternative embodiments, the effective cross-sectional area is any other suitable area.

This configuration maintains or improves the thermal efficiency of the furnace while using the combustion air blower 20 with the shaded pole motor 22. For example, and without limitation, the 125,000 BTU furnace with a permanent split capacitor motor and the first baffle 60 has a thermal efficiency of approximately 81.2 percent. The 125,000 BTU furnace with the combustion air blower 20 and the first baffle 60 has a thermal efficiency of approximately 81.5 percent.

For the 50,000 BTU furnace, the combustion air blower 20 is used with the second baffle 62. The second baffle 62 is larger than the first baffle 60. The embossment 66 cooperates with the second baffle 62 such that effective cross-sectional area of the discharge passageway 52 is at least about thirty one percent of the second cross-sectional area of the discharge passageway 52 and no more than about thirty four percent of the second cross-sectional area. In alternative embodiments, the embossment 66 cooperates with the first baffle 60 such that the effective cross-sectional area is at least about thirty two percent of the second cross-sectional area and no more than about thirty three percent of the second cross-sectional area. In further alternative embodiments, the effective cross-sectional area is any other suitable area.

This configuration maintains or improves the thermal efficiency of the furnace while using the combustion air blower 20 with the shaded pole motor 22. For example, and without limitation, the 50,000 BTU furnace with a permanent split capacitor motor and the second baffle 62 has a thermal efficiency of approximately 80.9 percent. The 50,000 BTU furnace with the combustion air blower 20 and the first baffle 60 has a thermal efficiency of approximately 81.6 percent. In contrast, the 50,000 BTU furnace with a combustion air blower having the shaded pole motor 22 and the second baffle 62 but without the embossment 66 has a thermal efficiency of 79.6 percent.

Therefore, the combustion air blower 20 with the embossment 66 allows for the use of a shaded pole motor 22 in a furnace while maintaining or improving the thermal efficiency of the furnace.

In view of the foregoing, it will be seen that the embodiments disclosed have several advantages.

The embodiments were chosen and described in order to best explain the principles of operation and practical application to thereby enable others skilled in the art to best utilize various embodiments and various modifications thereof.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

What is claimed is:

1. A method of installing a replacement combustion air blower comprising:

coupling the replacement combustion air blower to a furnace system such that a discharge conduit of the replacement combustion air blower is positioned to supply air to a combustion device of the furnace, wherein the replacement combustion air blower includes a blower housing, an impeller fan within the blower housing, an embossment adapted and configured to restrict airflow from the combustion air blower, and a baffle, the blower housing having an inlet and the discharge conduit, the discharge conduit extending away from the impeller fan, the discharge conduit having first, second, third and fourth walls, the first, second, third, and fourth walls of the discharge conduit defining a discharge passageway, the second wall being opposite the first wall, the third wall extending between the first and second walls, the fourth wall extending between the first and second walls, the first wall including a first portion and a second portion, the second portion of the first wall being upstream of the first portion of the first wall, the discharge conduit being adapted and configured to receive the baffle in the discharge passageway adjacent the first portion of the first wall of the discharge conduit such that when the baffle is projecting from the first wall in the discharge passageway the baffle extends inwardly into the discharge passageway from the first wall towards the second wall and restricts airflow within the discharge passageway, the embossment being on one or more of the second wall, the third wall, and the fourth wall, the embossment extending inwardly into the discharge passageway such that the embossment restricts airflow within the discharge passageway, the discharge passageway having a first cross-sectional area in a first plane perpendicular to and through the first portion of the first wall, the discharge passageway having a second cross-sectional area in a second plane perpendicular to and through the second portion of the first wall, the embossment being downstream of the second plane, the first cross-sectional area being less than the second cross-sectional area, the discharge conduit being adapted and configured such that when the baffle is within the discharge passageway and adjacent the first portion of the first wall, the discharge passageway has an effective cross-sectional area in the first plane, the effective cross-sectional area being the first cross-sectional area less the cross sectional area of the baffle in the first plane when the baffle is within the discharge passageway adjacent the first portion of the first wall, and selecting the baffle from among a first baffle and a second baffle, the size and shape of the embossment being different from the size and shape of the selected baffle.

2. A method in accordance with claim 1 further comprising removing an existing combustion air blower from the furnace system.

3. A method in accordance with claim 2 wherein the existing combustion air blower includes a permanent split capacitor motor, and wherein the replacement combustion air blower includes a shaded pole motor adapted and configured to drive the impeller fan.

4. A method in accordance with claim 1 wherein the furnace system is a 50,000 British thermal unit furnace.

5. A method in accordance with claim 1, wherein the selected baffle is the second baffle, and the second baffle has a cross sectional area of at least about fifty five percent of the second cross-sectional area and no more than about sixty five percent of the second cross-sectional area.

6. A method in accordance with claim 1 wherein the furnace system is a 125,000 British thermal unit furnace.

7. A method in accordance with claim 1, wherein the selected baffle is the first baffle, and the first baffle has a cross sectional area of at least about twenty percent of the second cross-sectional area and no more than about thirty percent of the second cross-sectional area.

8. A method in accordance with claim 1 wherein the furnace system is a 50,000 British thermal unit furnace, the method further comprising selecting the second baffle, the second baffle having a cross sectional area of at least about fifty five percent of the second cross-sectional area and no more than about sixty five percent of the second cross-sectional area.

9. A method in accordance with claim 1 wherein the furnace system is a 125,000 British thermal unit furnace, the method further comprising selecting the first baffle, the first baffle having a cross sectional area of at least about twenty percent of the second cross-sectional area and no more than about thirty percent of the second cross-sectional area.

10. A method in accordance with claim 1 further comprising placing the selected baffle within the discharge passageway in the first plane and coupling the selected baffle to the first wall of the discharge conduit.

11. A method in accordance with claim 1, the first baffle having a greater cross-sectional area than the second baffle.

12. A method in accordance with claim 1, the first plane extending through the embossment.

13. A method in accordance with claim 1, wherein a height of the embossment is less than a height of the selected baffle.

14. A method in accordance with claim 1, the selected baffle having an upstream face and a downstream face.

15. A method in accordance with claim 14, the upstream face of the selected baffle being substantially perpendicular to a direction of airflow within the discharge passageway.

16. A method in accordance with claim 14, the downstream face of the selected baffle being opposite the upstream face.

17. A method in accordance with claim 14, the first plane extending through the selected baffle between the upstream and downstream faces.

* * * * *